US007044685B2

(12) United States Patent
Wybro et al.

(10) Patent No.: US 7,044,685 B2
(45) Date of Patent: May 16, 2006

(54) METHOD OF INSTALLATION OF A TENSION LEG PLATFORM

(75) Inventors: Pieter G. Wybro, Houston, TX (US); Shukai Wu, Houston, TX (US); Johannes J. Treu, Sealy, TX (US); David E. Chaplin, Magnolia, TX (US)

(73) Assignees: Modec International LLC, Houston, TX (US); Sea Engineering Associates, Inc., Houston, TX (US)

( * ) Notice: Subject to any disclaimer, the term of this patent is extended or adjusted under 35 U.S.C. 154(b) by 1 day.

(21) Appl. No.: 10/789,659

(22) Filed: Feb. 27, 2004

(65) Prior Publication Data

US 2004/0190999 A1 Sep. 30, 2004

Related U.S. Application Data

(60) Provisional application No. 60/451,035, filed on Feb. 28, 2003.

(51) Int. Cl.
*E02D 29/09* (2006.01)
*E02B 17/08* (2006.01)

(52) U.S. Cl. ..... 405/207; 405/223.1

(58) Field of Classification Search ..... 405/223.1, 405/224, 224.1–224.4, 203, 209; 114/256, 114/263, 264, 265

See application file for complete search history.

(56) References Cited

U.S. PATENT DOCUMENTS 3,681,928 A * 8/1972 Vincken et al. ..... 405/196
4,604,001 A * 8/1986 Wetmore ..... 405/224
5,551,802 A * 9/1996 Wybro ..... 405/223.1
6,003,466 A 12/1999 Dove et al.
6,106,198 A * 8/2000 Borseth ..... 405/223.1
6,210,075 B1 4/2001 Korloo
6,244,785 B1 6/2001 Richter et al.
6,499,418 B1 12/2002 Pollack
6,517,291 B1 2/2003 Pollack

OTHER PUBLICATIONS

Breaux, Dwayne. Engineering Technology for TLP Installations, Marine Construction 2003 Conference, Houston, Texas, Feb. 20, 2003.
"Tension Base TLP can support development in 4,000 ft depths" by Nagan Srinivasan; *Offshore,* Mar. 1995; pp. 48-50, 65 and 69.
"Tensioned raft/frame design reduces TLP motions, costs" by P. Abbot, et al.; *Offshore,* Aug. 1994; pp. 42, 44, 47-48 and 62.

* cited by examiner

*Primary Examiner*—Michael Safavi
*Assistant Examiner*—Gay Ann Spahn
(74) *Attorney, Agent, or Firm*—Gary L. Bush; Andrews Kurth LLP

(57) ABSTRACT

A method and system for attaching a TLP to its tendons using pull-down lines to rapidly submerge the hull to installation draft while compensating for inherent hull instability during submergence and to provide motion arrest and aid in station keeping. The system includes tensioning devices mounted on the TLP, usually one for each tendon. Each tensioning device is equipped with a pull-down line which is connected to the corresponding tendon. The TLP hull is submerged to lock-off draft by applying tensions to the pull-down lines connected to the top of the tensions, or by a combination of applying tensions to the pull-down lines and ballasting the hull. As the tensioners take in pull-down line, the hull submerges, i.e. the draft increases. After lock-off, high levels of tension in the pull-down lines can be rapidly transferred to the connection sleeves by slacking the pull-down lines, thus allowing the TLP to be made storm-safe much faster than by prior art methods which require de-ballasting to tension the tendons. In concert with TLP installation, the method may be used attach the mooring tendons to the seabed by suspending and lowering the tendons into their foundation receptacle in the seabed.

23 Claims, 11 Drawing Sheets

METHOD OF INSTALLATION OF A TENSION LEG PLATFORM

CROSS REFERENCE TO RELATED APPLICATION

This application is based upon provisional application 60/451,035 filed on Feb. 28, 2003, the priority of which is claimed.

BACKGROUND OF THE INVENTION

1) Field of the Invention

The present invention relates generally to floating vessels, both traditional "ship-shaped" vessels and semi-submersible vessels. The invention relates more particularly to a method of installing a tension leg platform and connecting it to mooring tendons/tethers and connecting the tendons to foundations, such as driven or drilled piles, suction piles or suction gravity caissons, which are anchored in the seabed.

2) Description of the Prior Art

In the offshore oil and gas industry, floating vessels such as tension leg platforms (TLPs) for drilling and/or production are common. A TLP is a type of floating platform that is used for drilling and production in relatively deep water. The TLP is moored using vertical tendons (also referred to as tethers) connected to foundations anchored in the seabed. The tendons are tensioned by the buoyancy force of the TLP hull, which is submerged or partially submerged.

Depending on its configuration, the stability of a TLP with or without an integrated deck may be inadequate during installation. When a TLP is ballasted between the initial free floating draft (e.g. the wet-tow draft or float-off draft) and the lock-off draft (the draft at which securing the TLP to the tendons is initiated), there is a range of drafts at which the TLP stability is critical—the TLP may be unstable or marginally stable prior to being locked off to the tendons. There are a number of ways to make the TLP stable. For example, a combination of wider column spacing and/or larger columns may be used to increase stability. Alternatively, the topsides deck may be installed offshore after the hull is connected to the tendons. Offshore installation of the deck is an expensive, high-risk operation and requires good weather.

Because of the stability concerns of a TLP when transiting the installation drafts before being locked off, prior art installation techniques have often relied on using costly specialized installation equipment such temporary buoyancy modules to keep the hull from capsizing before it can be secured to its mooring tendons and subsequently de-ballasted.

Another method to maintain stability is the use of an upward hook load to the TLP by a larger installation support vessel. A hook load has the advantage of being able to quickly tension the tendons after lock-off without waiting for the slow de-ballasting process. However, only a a very limited number of vessels exist worldwide which are capable of providing the required hook load for a TLP of ordinary size.

However, U.S. Pat. No. 5,551,802 describes a method which overcomes the need for special installation equipment and allows the TLP to be installed with just a conventional deep water drilling vessel and assist tugs. After the TLP is towed over the preinstalled mooring tendons, it is held in position by deep water drilling vessel and tugs. As the hull ballasts, it is held with downward tension near each connector sleeve (sometimes known as a slip nut or slips assembly) by tensioning lines, attached to the tips of the tendons, passing through the corresponding connection sleeves and passing through ratcheting cleats or grippers mounted directly above the connection sleeves. The tensioning lines are tensioned by constant tension devices. The grippers serve to check any upward movement. For the unstable hull to capsize, one side must rotate up, which is not possible when downward tension is applied at the various connection points.

While this latter-described prior art method has many advantages over its predecessors, because the grippers are mounted on the hull below the waterline, the method suffers from risk of gripper slippage, difficult gripper installation, operation, maintenance and removal. Rigging the tensioning lines can be problematic. Further, because grippers do not allow selective paying out of line, high transient loads can occur. It is desirable to be able to haul in and pay out line during installation to maintain the tensioning lines within a window of safe operating tensions.

Further, it is desirable to minimize the time required for installation by reducing the amount of ballasting and deballasting (i.e. ballast manipulation) required to install the TLP. By reducing the ballast and de-ballast times, the time the TLP is at risk to weather and instability is also reduced.

3) Identification of Objects of the Invention

A primary object of the invention is to provide a method of TLP installation, which provides stability to TLP during transit through the various installation drafts without the need for hook loads or temporary buoyancy modules.

Another primary object of the invention is to provide a motion-arresting capability that reduces the TLP heaving motions at the TLP drafts close to the lock-off draft, and enables a safe and simultaneous lock-off of the tendons to the hull.

Another primary object of the invention is to provide a TLP installation system which aids in TLP station keeping during the installation process.

Another primary object of the invention is to provide a system for rapidly submerging the TLP hull without ballasting or with minimal ballasting and/or ballasting manipulation to minimize the time during which the TLP is made to transit the TLP installation drafts. By eliminating or reducing ballasting, the required tendon pre-tension can be rapidly achieved after tendon lock-off without the need for a lengthy de-ballasting process.

Another object of the invention is to provide a method for the installation of a TLP hull with an integrated deck. When the deck is integrated with the hull onshore, pre-commissioning is possible which saves offshore commissioning time and reduces the risks as well as costs associated with marine installation. The invention eliminates the need to use a crane vessel, derrick barge or other lifting mechanism for offshore deck installation and can therefore reduce the installation cost.

Another object of the invention is to provide a method for installation of a TLP with an integrated deck in potentially higher seastates than is normally allowable for offshore lift installation of the deck, for installation with the use of temporary buoyancy modules, or for installation using an upward hook load to the TLP by a larger installation support vessel.

Another object of the invention is to provide a method of TLP installation equally suitable for a TLP hull with or without a pre-installed deck, or for installation of a semi-submersible or any floating platform wherein the tendons are replaced by vertically-tensioned chains or wire ropes, synthetic lines or other equivalent.

Another object of the invention is to provide a TLP installation system which minimizes the time during which the TLP can have a resonant frequency with external exciting system (e.g. wave frequencies of the surrounding water).

Another object of the invention is to provide a TLP installation system in which the major components can be easily removed after TLP and riser installation.

Another object of the invention is to provide a TLP installation system having minimal underwater components.

Another object of the invention is to provide a TLP installation method which can be used to aid in the installation of the tethers, thus eliminating the need for tendon support buoys.

SUMMARY OF THE INVENTION

The objects identified above, as well as other features and advantages of the invention are incorporated in a method and system for installing a TLP and attaching it to its tendons using tensioning lines to rapidly submerge the hull to lock-off draft with minimal ballasting. The system, which compensates for TLP instability or enhances TLP stability during submergence, includes tensioning devices mounted above water, which may be winches, strand jacks, or other equivalent devices capable of providing adequate pull. The tensioning devices may be mounted on the TLP columns, on the deck, or on other supporting structures. At least one main tensioning or pull-down line connects each tendon to the tensioner. Pull-down lines, which may be chain, rope, synthetic line, rod, pipe, a combination thereof or other equivalent, are led through the connection sleeves inside tendon porches and are connected to the tops of the corresponding tendons. During installation, the pull-down lines are tensioned and are pulled vertically through the tendon porches using the tensioners. Fairleads may be used to guide the pulldown lines for a vertical pull and are generally located above the porches.

When the weather is favorable, the TLP hull is submerged to lock-off draft by applying tensions to the pull-down lines connected to the top of the tensions, or by a combination of applying tensions to the pull-down lines and ballasting the hull. As the tensioners take in pull-down line, the hull submerges, i.e. the draft increases. Despite any instability inherent in the hull during installation, the system provides the stability required for safe installation. If a combination of pull-down and ballasting is used, it is advantageous to commence installation with a quick pull-down to reduce the transition time and the peak dynamic effects through the initial draft range. During any concurrent ballasting, sufficient tensions in the pull-down lines should be maintained for promoting hull stability, arresting motion and aiding in station keeping.

Upon reaching lock-off draft, it is advantageous for high levels of tension in the pull-down lines to exist. The tendons are clamped inside the connection sleeves or equivalently locked off. The system provides motion arrest for a rapid locking off of the hull. Once the tendons are locked-off, the required tendon pre-tension can be achieved very rapidly by transferring the high pull-down line tension to the connection sleeves. The tension is transferred by slacking the pull-down lines, thus allowing the TLP to be made storm safe much faster than by prior art methods which require mostly de-ballasting to tension the tendons. If appropriate, the TLP is then de-ballasted to reach design tendon tension.

In addition to installing a TLP to moored tendons, the method of the invention may be used to install a TLP including attaching the mooring tendons to the seabed foundations. In this case, the tensioning lines are attached to the tendon tips before the tendons are moored. The TLP with tendons suspended therefrom is positioned over the mooring site. One at a time, the tendons are lowered from the floating TLP and positioned and sequentially locked into their foundation receptacle in the seabed. The tensioning lines support the tendons and keep the tendons oriented vertically, thus obviating the need for tendon support buoys. Additionally, the pull-down lines are more easily connected to the tendons because the tendons can be raised through the connection sleeves so that their tips are above water.

BRIEF DESCRIPTION OF THE DRAWINGS

The invention is described in detail hereinafter on the basis of the embodiments represented schematically in the accompanying figures, in which.

DESCRIPTION OF PREFERRED EMBODIMENTS OF THE INVENTION

Figure 1:
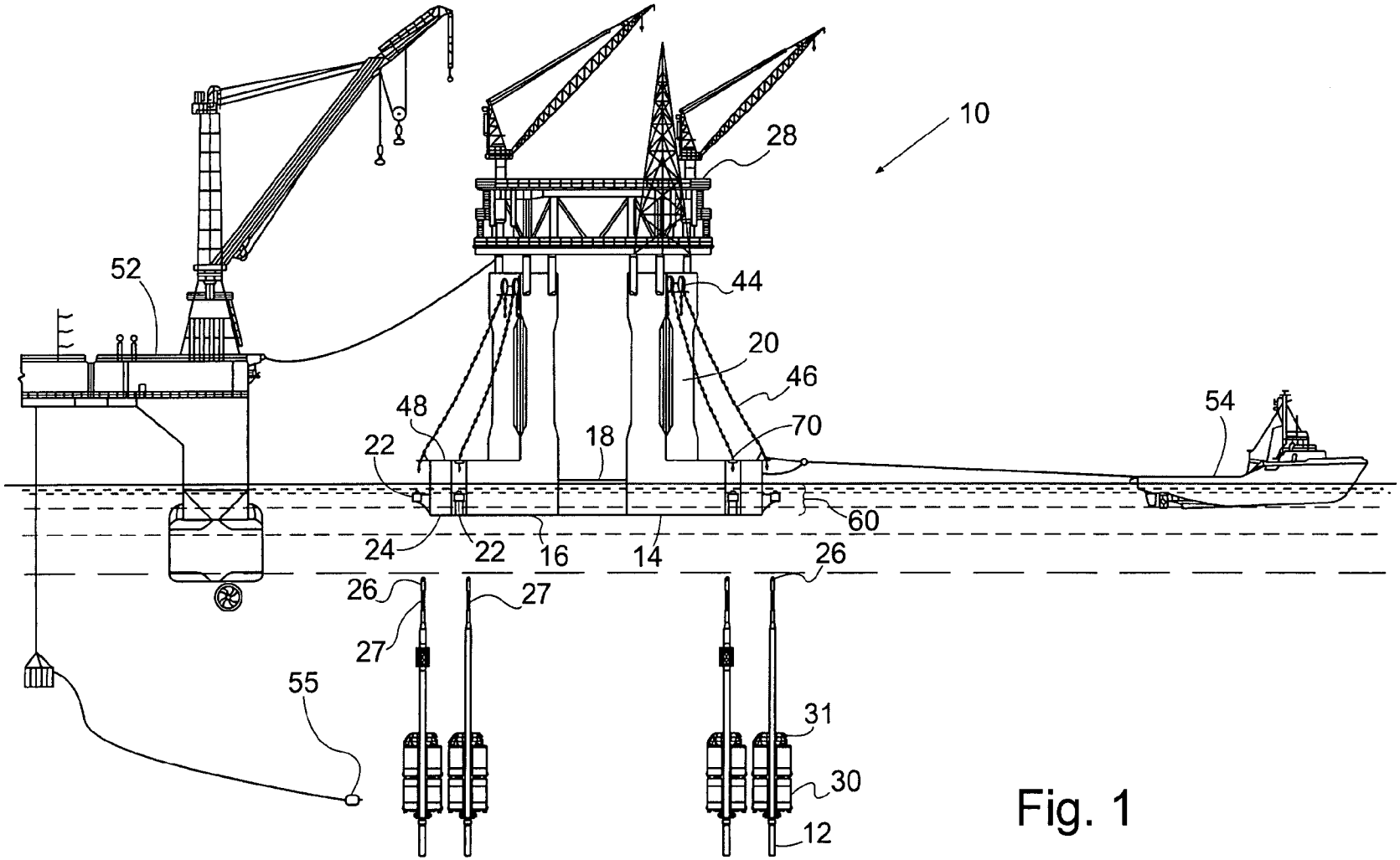
FIG. 1 is a side view which illustrates towing to the installation location a TLP with integrated superstructure and rigged according to the invention.
Figure 2:
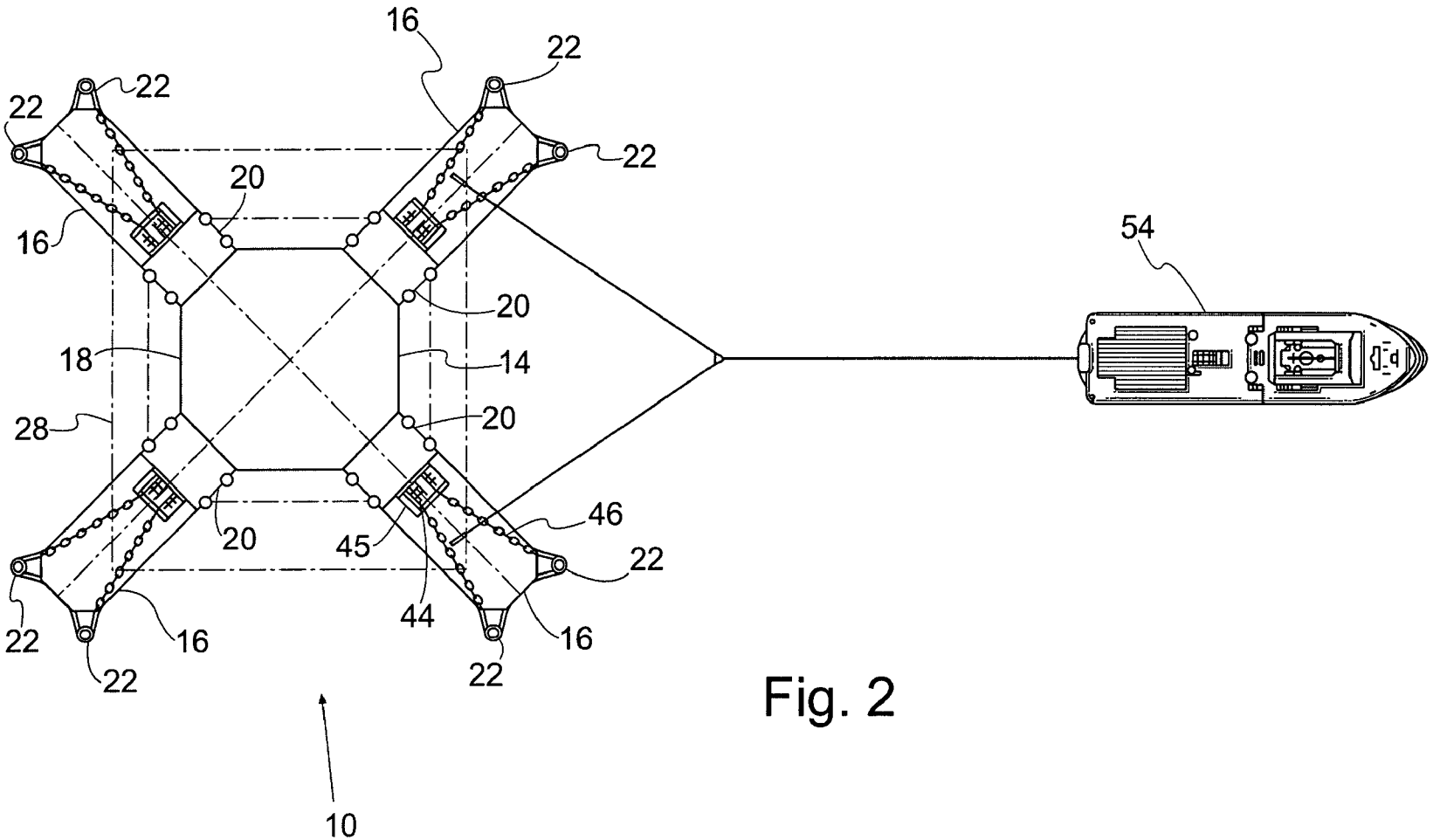
FIG. 2 is a top view of FIG. 1.

A preferred embodiment of the invention is in a method and system for installing a TLP 10 to its vertical or near vertical mooring tendons 12. As shown in FIGS. 1 and 2, the TLP has a hull 14 comprising submerged or partially submerged pontoons or tendon support structures (TSS) 16 and a submerged or partially submerged base structure 18. The hull has a keel 24 and a top 48. The hull 14 has one or more vertical columns 20 extending upwards thereon which penetrate the surface of the water when the TLP is at installed draft. The hull 14 may support an integrated platform superstructure 28, which consists of one or more decks for drilling, production and processing equipment, support structures and human use.

Each tendon support structure 16 is designed to mate with at least one, but usually two or more tendons 12. The tendon support structures 16 include tendon porches located near the keel 24 which contain connection sleeves 22 to receive the upper tips 26 of the tendons 12 and clamp thereto. The connection sleeves 22 may be ring-shaped, requiring vertical entry of the tendons, or they may be slotted to allow side entry of the tendons. Either type of connection sleeve is compatible with the invention.

For each tendon 12, the TLP 10 is fitted with a tensioning device 44 which may be a winch, strand jack, linear jacking device, or equivalent device. The tensioning devices 44 are typically mounted to the side of the columns 20, on the superstructure 28, or on temporary support structures. Tensioning devices are typically located such that they stay above water during installation, but they may be temporarily submerged. The tensioning devices may be removable so that they may be used elsewhere after completion of the installation. One or more control stations (FIG. 3) are provided to control the tensioners 44.

Figure 3:
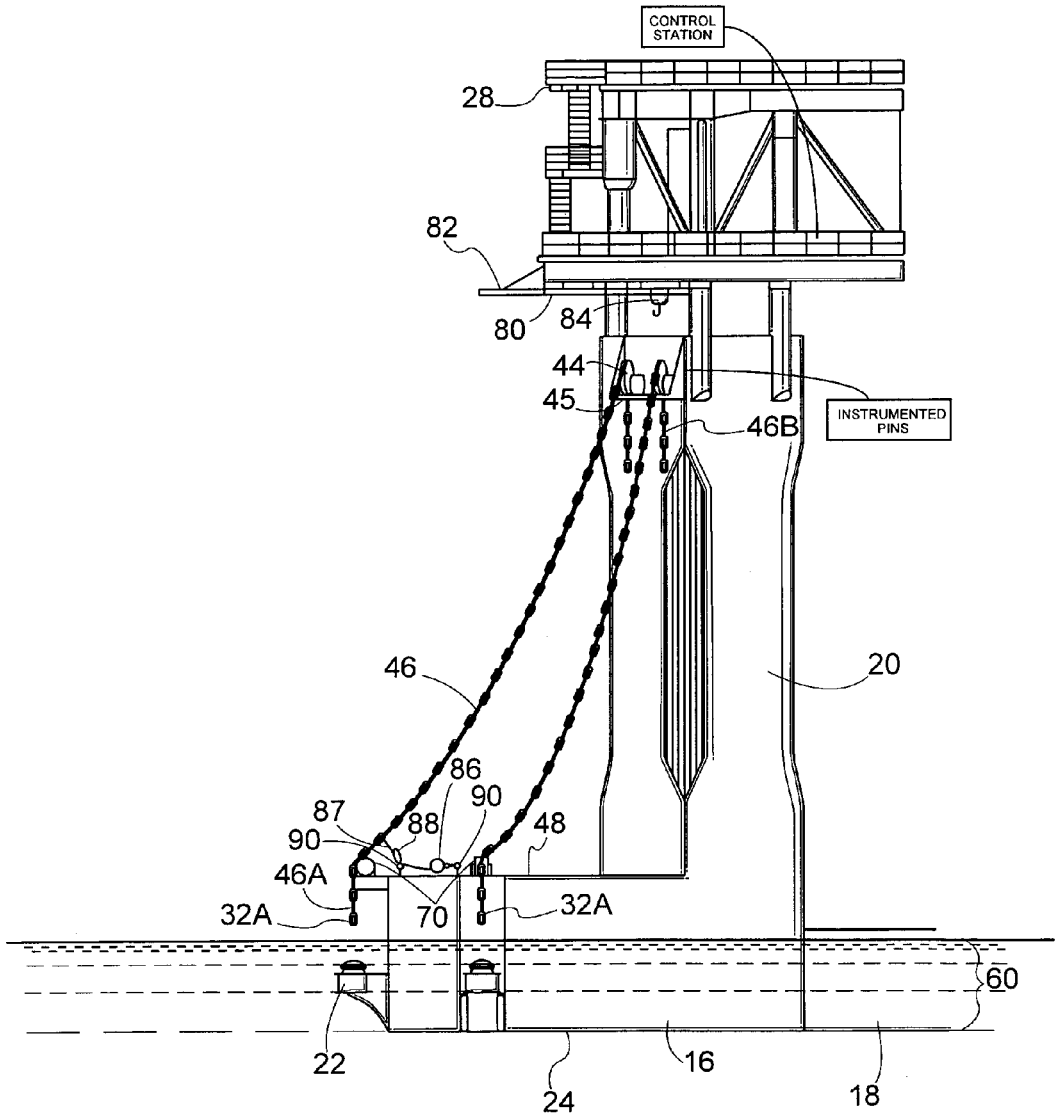
FIG. 3 shows an example of a TLP equipped with winches mounted to the column and fairleads which are rigged with pull-down line, according to the invention.

In the embodiment illustrated in FIG. 3, the tensioners 44 are winches mounted above the waterline near the top of the vertical column 20. The winches 44 are preferably pre-installed on removable support platforms 45 pinned to the sides of the columns 20. The winch supports 45 include instrumented pins to provide continuous readout of the line tension. The winches are preferably equipped with fail-safe brakes and high-slip induction motors which do not lose torque at stall. Although not specifically illustrated in FIG. 3, a stopper or gripper may be incorporated into the system for emergency stoppage, planned relief of the tensioning members or tensioning devices, or for prevention of reversal, backlash or ratcheting during the tensioning process. For example, winches 44 may include a line stopper.

Each tensioning device 44 is rigged with a pull-down line 46 for connecting to the top of a tendon 12. FIG. 3 illustrates the pull-down line 46 as studless chain, but other lines including wire rope, hawsers, rod pipe or equivalent may be used. During pre-rigging, the distal end 46A of the pull-down line is temporarily fastened to the top 48 of the hull above the connection sleeve 22. On the slack side of the winch, the extra line 46B hangs freely alongside the column 20. The rigging can be done at a staging area, marshalling yard, hull fabrication site, hull/deck integration site, or at the offshore installation location.

Figure 4:
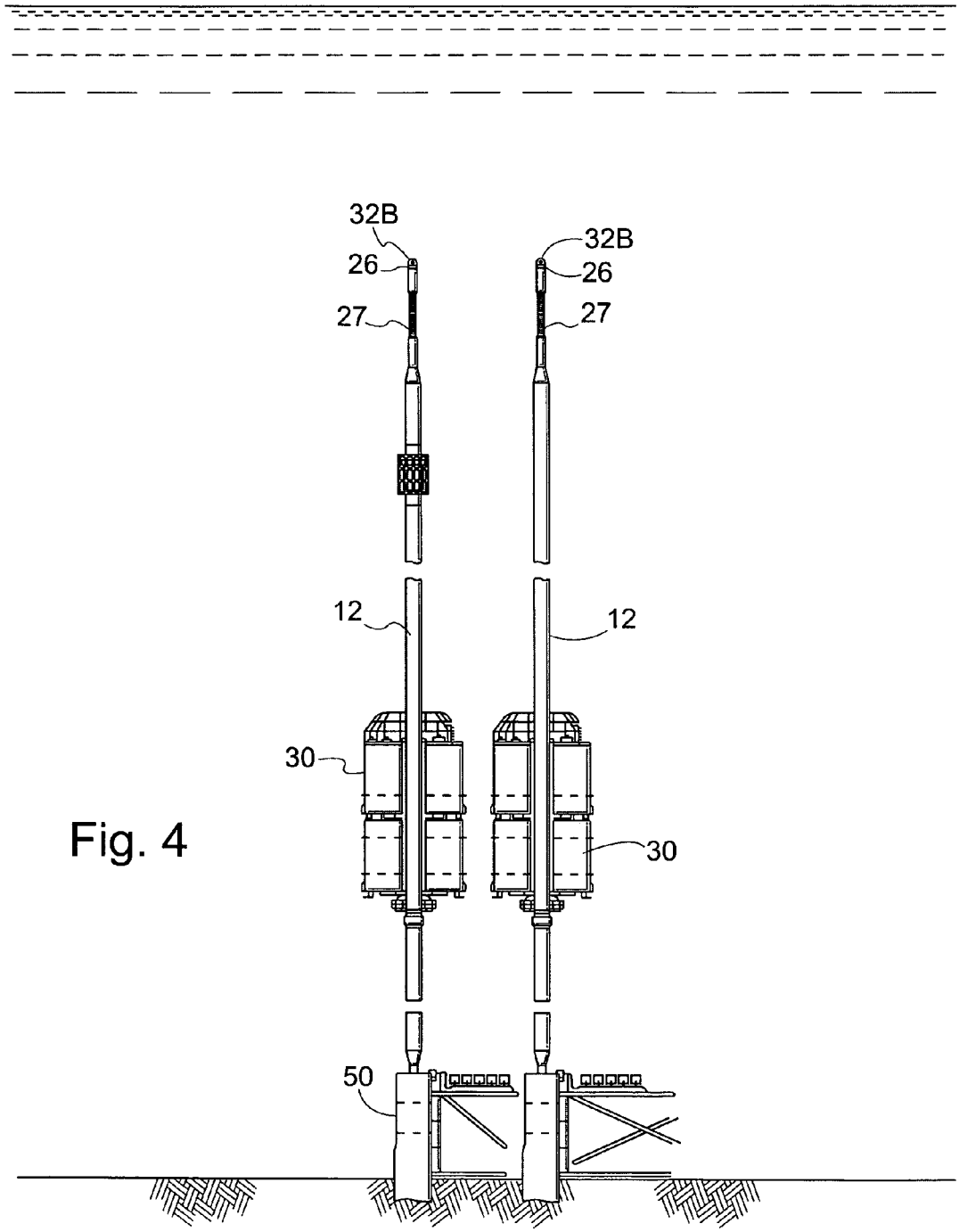
FIG. 4 illustrates pre-installed mooring tendons which are anchored to the seabed and are held in place with temporary tendon support buoys.

Each pull-down line is designed to connect to its corresponding tendon 12. For example, as shown in FIGS. 3 and 4, a quick-connect pull-down connector assembly is used, with the male end 32A connected to the pull-down line 46 by an round-pin connecting shackle and the receptacle end 32B fixed to the tip 26 of the tendon 12. Due to the size of the connecting hardware, the tendon length adjusting joints 27 and the connecting sleeves 22 may be oversized as compared to prior art counterparts.

During the TLP installation, the tensioners 44 apply tension to the tips of the tendons 12 using the pull-down lines 46. Tension should be applied to the top of a tendon vertically or nearly vertically. For this reason, the pull-down lines are typically directed through the connecting sleeve 22, but the lines may be temporarily outside the sleeve 22 during the initial stage of tensioning. Fairleads may be used to guide the tensioning member from the top of the tendon to the tensioning device and to ensure verticality of the tension at the top of the tendon. For example, as illustrated in FIG. 3, fixed vertical line fairleads 70 are mounted at the end of the tendon support structures 16 to route the pull-down lines 46 vertically through the center of the connection sleeves 22. Each fairlead 70 is mounted onto a special foundation at the end of the tendon support structure 16 using pinned connections which allow removal and re-installation of the fairlead. Because the fairleads 70 cannot be reached by onboard TLP cranes, they must be removed or installed by an installation support vessel crane or A-frame.

As illustrated in FIG. 3, air powered or electric powered tugger winches 86, with suitable wire or synthetic rope 87 for moving the pull-down lines around the top 48 of the hull, may be installed during pre-rigging. Several snatch blocks 88 and snatch block padeyes 90 may be required to route the tugger lines where needed. Padeyes 90 on the hull top 48 may be incorporated at the hull fabrication yard.

Also shown in FIG. 3, the underside of the superstructure 28 may be equipped with trolley rails 80 mounted from a position directly above the winches 44 to a position along the edge of the deck. The rails are used for the removal of the winches 44 and winch support platforms 45. The rails may be extended beyond the edge of the deck by removable extension rails 82 to allow sufficient clearance beyond the deck for a topsides deck crane to transfer loads from trolley system. Because a trolley hoist 84 can be installed or removed from the trolley rails with a deck crane, one or two trolley hoists 84 can be used to sequentially remove all the winches 44 and support platforms 45. Ideally, the deck crane is capable of lifting the extension rail 82, trolley hoist 84 and trolley hoist payload simultaneously for speedier component removal. Although in this specific embodiment the tensioning devices 44 are removable, permanently installed tensioning devices may be used as well.

The TLP installation method according to the invention can be used to draft and lock off a TLP to conventionally pre-installed tendons, or it can provide a streamlined and combined procedure for installing the tendons with the TLP. Referring to the former case, FIG. 4 shows pre-installed tendons 12, with their lower ends 50 anchored to the seabed. They may be maintained in a vertical position with optional temporary tendon support buoys 30 attached thereto. However, tendon support buoys do not have to be used. For example, the pull-down lines 46 may be used to eliminate the tendons 12 from going slack prior to TLP installation. Additionally, secondary tensioning lines from an assembly vessel or installation support vessel may be used in place of pull-down lines 46 or to supplement pull-down line tension. The upper end of each tendon has a length adjustment joint (LAJ) 27 for trimming the TLP. The tip 26 is fitted with a pull-down connector receptacle 32B.

The sequence of TLP installation using conventionally pre-installed tendons 12 is now described. Referring back to FIG. 1, a dynamically positioned or moored installation support vessel 52 is generally provided on location and equipped with mooring hawsers for connecting the TLP 10. This vessel does not require heavy lifting capabilities, but should be equipped with an offshore crane, a remotely operated vehicle (ROV) 55, and all other equipment and services required for the work. The ROV 55 inspects the tendons 12 and tendon support buoys 30, if installed, to ensure they are not damaged and are ready for hookup.

The TLP 10 is towed to location at a tow draft 60 which has ample freeboard to the top 48 of the hull 16 to allow riggers to work safely on the hull 14 as needed. A first side of the TLP 10 is connected to the mooring hawsers on the ISV 54, and at least one capable towing vessel 52 remains connected to the TLP 10 on the opposite side. The TLP 10 is maneuvered and maintained directly over the pre-installed tendons 12, with an ROV 55 observing. A weather forecast is assessed prior to proceeding with the TLP 10 hookup to the tendons 12.

As illustrated in FIG. 3, the bitter ends 46A of the pull-down lines 46 are unfastened from the hull 16, and the pull-down lines 46 are lowered through the connection sleeves 22 toward the pull-down connector receptacle located at the tendon upper tip 26. Initially there may not be enough line weight below the fairlead 70 to freely lower a pull-down line 46. In this case, the pull-down line 46 can be actively pulled using a tugger line 87, which is rigged from the hull top 48 through a snatch block 88 on the end of the TSS 16, and connected to a tuning fork shackle or sling coupled to the pull-down line 46 a short distance inboard of the connection sleeve 22.

Figure 5:
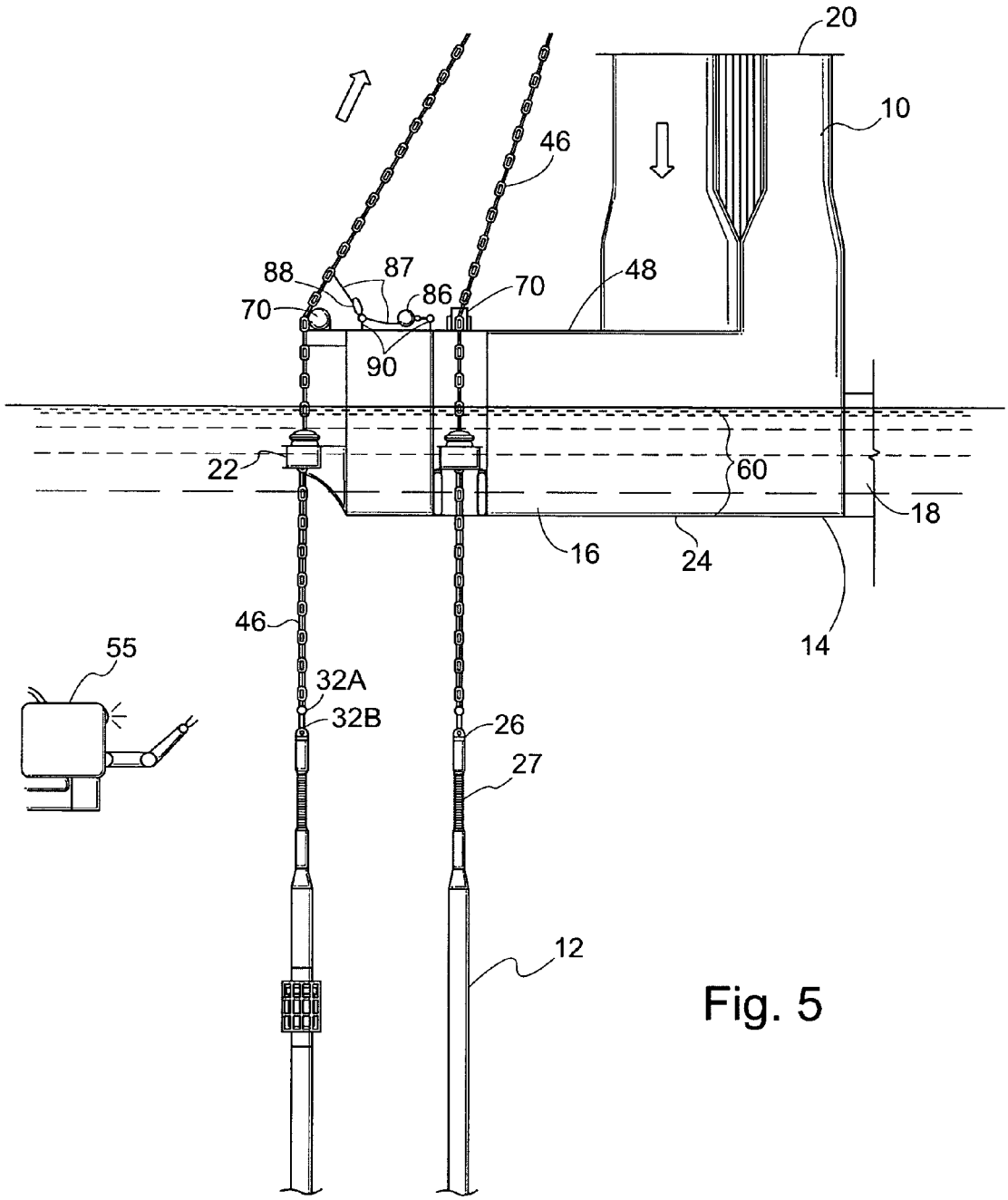
FIG. 5 illustrates a step in the method of TLP installation according to the invention wherein the TLP is aligned above the tendons, and the pull-down lines are attached to the tops of the tendons.

Referring now to FIG. 5, the pull-down connector 32A is guided into the receptacle 32B on top of the LAJ 27 with ROV 55 assistance. The pull-down male connector 32A is fully lowered into the pull-down connector receptacle and is locked in place. The ROV 55 ensures that the pull-down connector is secure. Once one pull-down line 46 on each TSS 16 is connected to its corresponding tendon 12, some tension may be applied to assist with TLP 10 station keeping, if required.

After all pull-down lines 46 are connected to their tendons 12, the tensioners 44 and lines 46 are tested by increasing the tension on all lines 46 gradually and simultaneously. Line tensions, draft, heel and trim are monitored carefully during this component testing, and the pull-down connectors at the tendon tips 26 are inspected using an ROV 55. Riggers also check the line lay over the fairleads 70.

Figure 6:
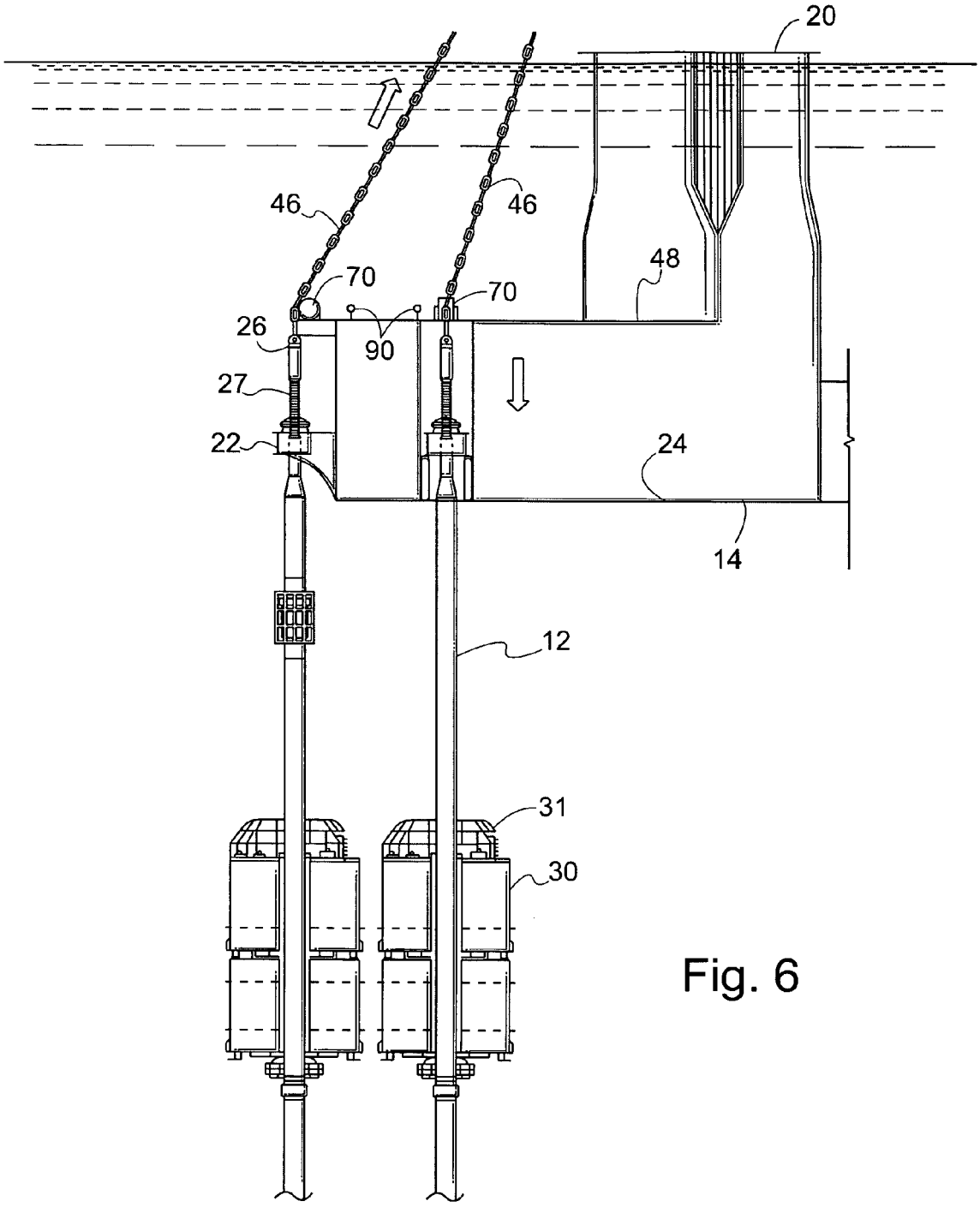
FIG. 6 illustrates a step in the method of TLP installation according to the invention wherein the TLP is at lock-off draft, the tendons have passed through the connecting sleeves, and the TLP is ready for lock-off.

As shown in FIGS. 5 and 6, if the weather forecast remains favorable, the TLP hull 14 is submerged to lock-off draft by applying tensions to the pull-down lines connected to the top of the tendons, or by a combination of applying tensions to the pull-down lines and ballasting the hull. As the tensioners 44 take in pull-down line 46, the hull 14 submerges, i.e. the draft increases. Despite any instability inherent in the hull during installation, the system provides the stability required for safe installation. If a combination of pull-down and ballasting is used, it is advantageous to commence installation with a quick pull-down to reduce the transition time and the peak dynamic effects through the initial draft range. During any concurrent ballasting, sufficient tensions in the pull-down lines should be maintained for promoting hull stability, arresting motion and aiding in station keeping.

Figure 7:
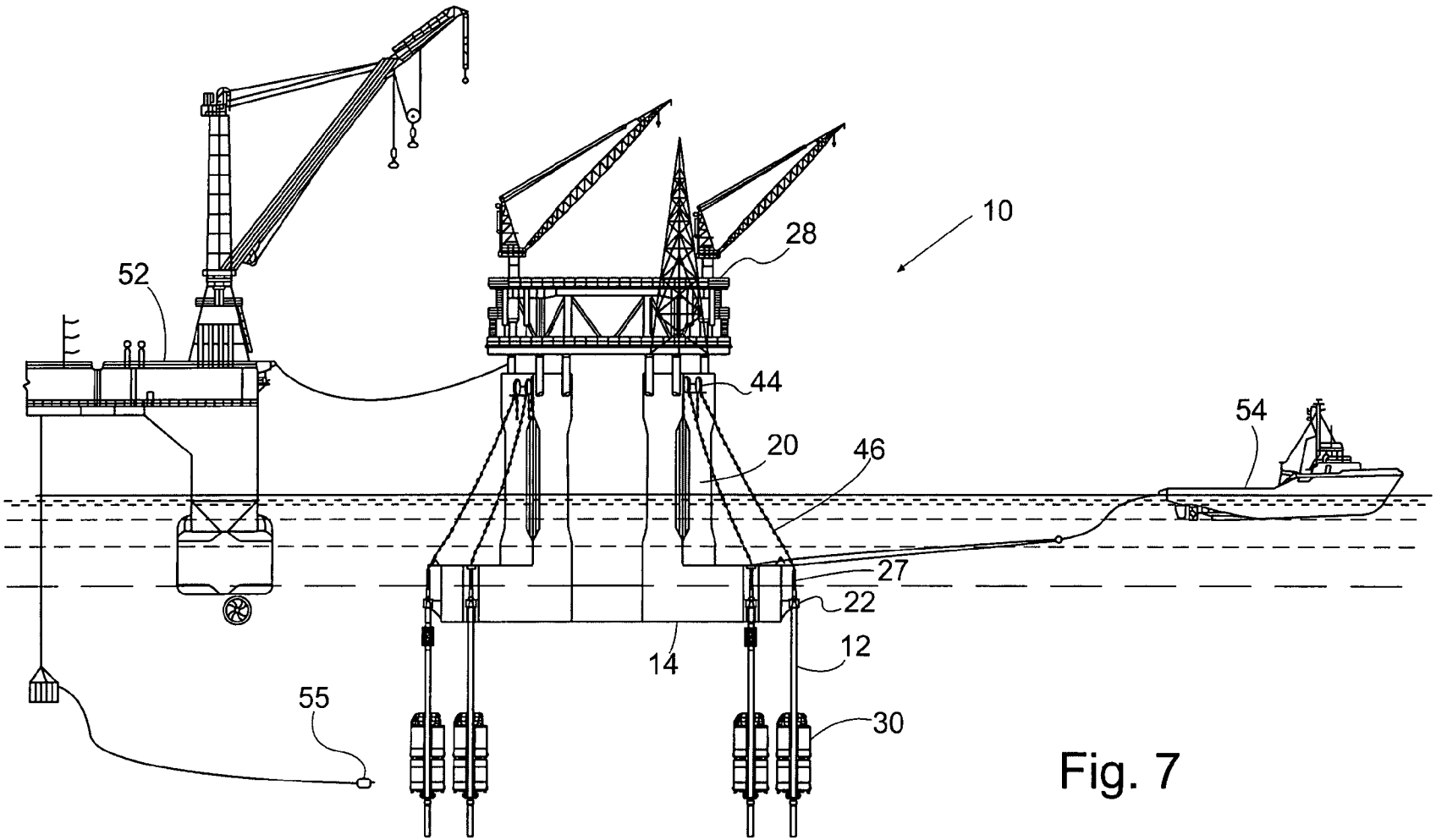
FIG. 7 illustrates the TLP of FIG. 1 at lock-off draft.

Referring to FIG. 7, upon reaching lock-off draft it is advantageous for high levels of tension in the pull-down lines 46 to exist. The tendons 12 are clamped inside the connection sleeves 22 or equivalently locked off. The system provides motion arrest to promote rapidly locking off the hull 14. Once the tendons 12 are locked-off, a storm safe tendon tension can be achieved very rapidly by transferring the high pull-down line tension to the connection sleeves 22. The tension is transferred by slacking the pull-down lines 46, thus allowing the TLP to be made storm safe much faster than by prior art methods which require de-ballasting to tension the tendons. The tendon support buoys 30, if used, are removed, and the TLP 10 may be de-ballasted to increase tendon tension to a nominal value, completing the TLP lock-off operations.

The method of TLP installation according to the invention is described above using winches removably mounted on the columns 20 as tensioners 44 and studless chain as pull-down lines 46 to install the TLP 10 to pre-installed tendons 12.

Figure 8:
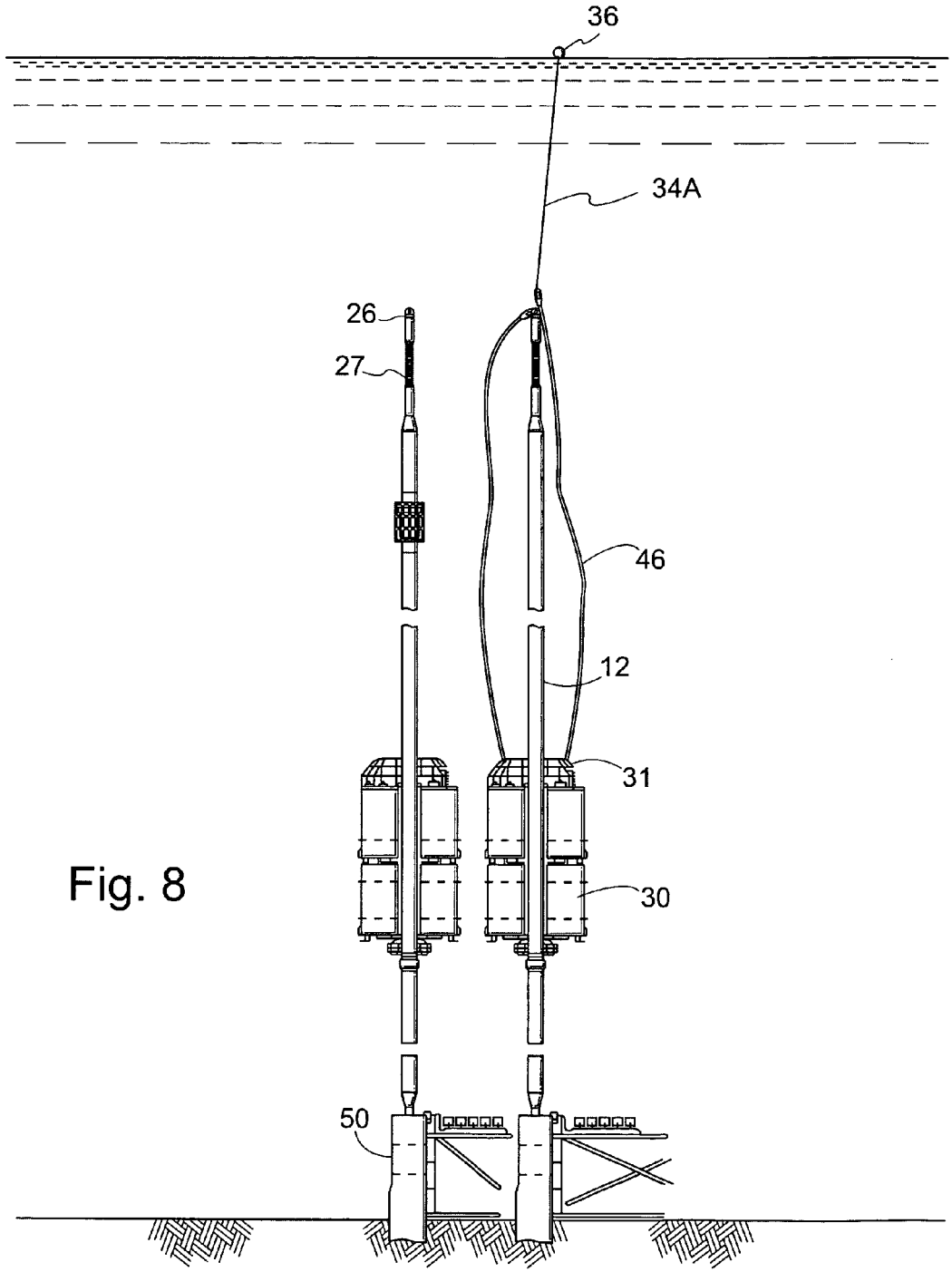
FIG. 8 illustrates pre-installed mooring tendons, one of which is equipped with a pull-down line and messenger.
Figure 9:
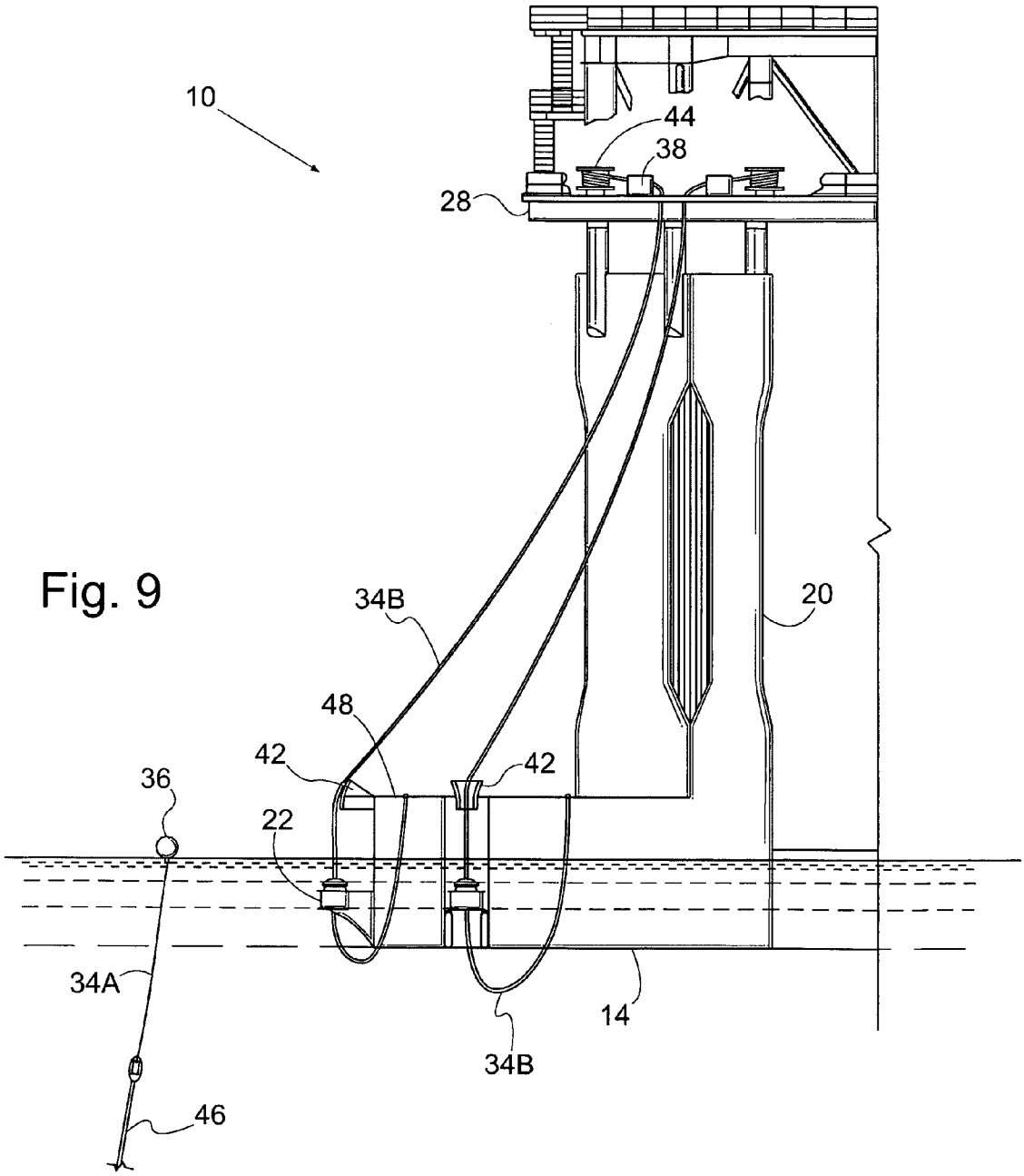
FIG. 9 shows an example of a TLP equipped with tensioning devices and grippers located in the superstructure according to the invention.

FIGS. 8 and 9 illustrate an alternate embodiment of the invention. FIG. 8 again depicts pre-installed tendons 12, but each tendon is now rigged with a tensioning or pull-down line 46. The tensioning line 46 may be chain, wire rope, aramid braid or the like, and is terminated with a messenger 34A and small surface buoy 36. The tensioning lines 46 may be faked in baskets 31 attached to the top of the tension support buoys 30, if installed.

For each tendon 12, the TLP 10 is fitted with a tensioner or jacking device 44, such as a linear winch, which is preferably mounted above the waterline such as in the superstructure 28 or near the top of the vertical column 20. In FIG. 9, the tensioners 44 are located in superstructure 28. The TLP 10 is also fitted with a corresponding number of grippers, stoppers, ratcheting cleats or equivalent devices 38, installed usually, but not necessarily, above the waterline and structurally fixed to the hull, deck, or a rigid appurtenance. The purpose of a gripper 38 is to check outward motion of a line within it but allow free inward motion. In FIG. 9, the grippers 38 are shown located shown located in the superstructure 28.

Each tensioner 44 is pre-rigged with a messenger 34B fixed thereto, extending through one or more grippers 38, the corresponding connection sleeve 22 from top to bottom, and fastened to the hull top 48 for later retrieval. To guide the messenger 34 or tensioning line 46, a bending shoe 42 is mounted on the tendon support structure 16 directly above the connection sleeve 22. The pre-rigging can be done at a staging area, marshalling yard, hull fabrication site, or at the installation location.

Next, the tensioning line messengers 34A floating in the water at buoys 36 are mated to the tensioner messengers 34B, which were staged on the hull top 48. The tensioners 44 are engaged, feeding the tensioning lines 46 through the connection sleeves 22, through the grippers 38 and onto the tensioner 44. The grippers 38 are then enabled to prevent the tensioning lines 32 from being let out. Tensioners 44 take in tensioning line 46, lowering the TLP hull. Concurrent ballasting of the hull 14 may be required to reach lock-off draft without creating excessive pull-down or tendon tensions. The connection sleeves 22 are lowered on to the tendons 12, which are then locked-off. The tensioning line tension is then rapidly transferred to the connection sleeves 22 by disengaging the grippers 38 and easing out the tensioners 44. After installation, the tensioning lines 46, grippers 38, tensioners 44, and tendon support buoys 30 (if used) may then be removed if desired.

A third embodiment of the invention, where the tendons 12 are installed in concert with the TLP, is now described. Additionally, this embodiment is described using a strand jack tensioning device 44, although any suitable tensioner may be used. Strand jacks are commonly used for prestressing concrete and are commercially available.

Figure 10:
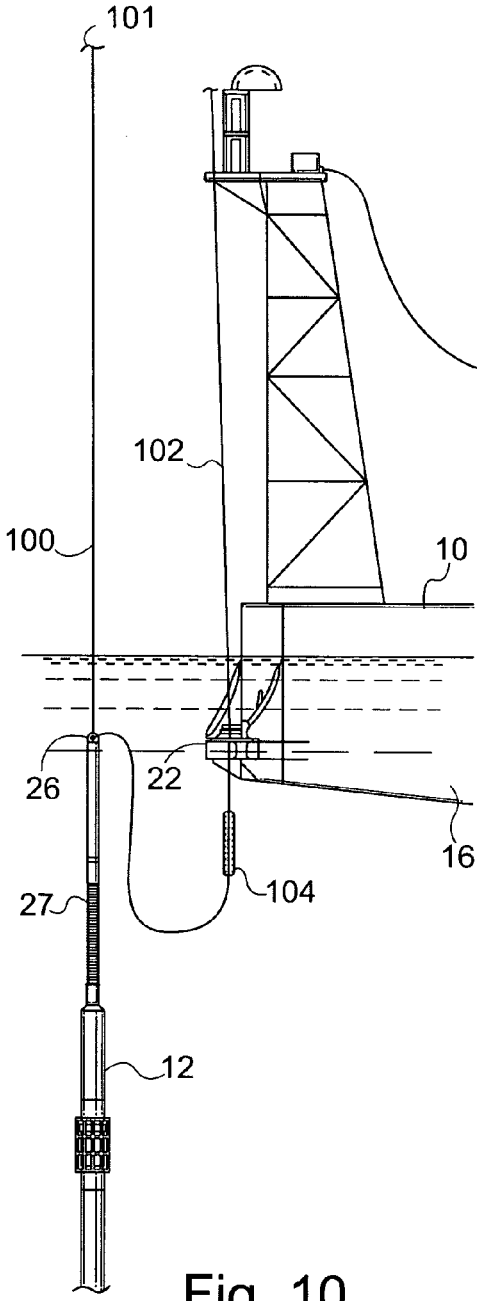
FIG. 10 illustrates a step in the method of tendon installation according to the invention wherein a tendon is ready for transfer from an assembly vessel to the TLP.
Figure 11:
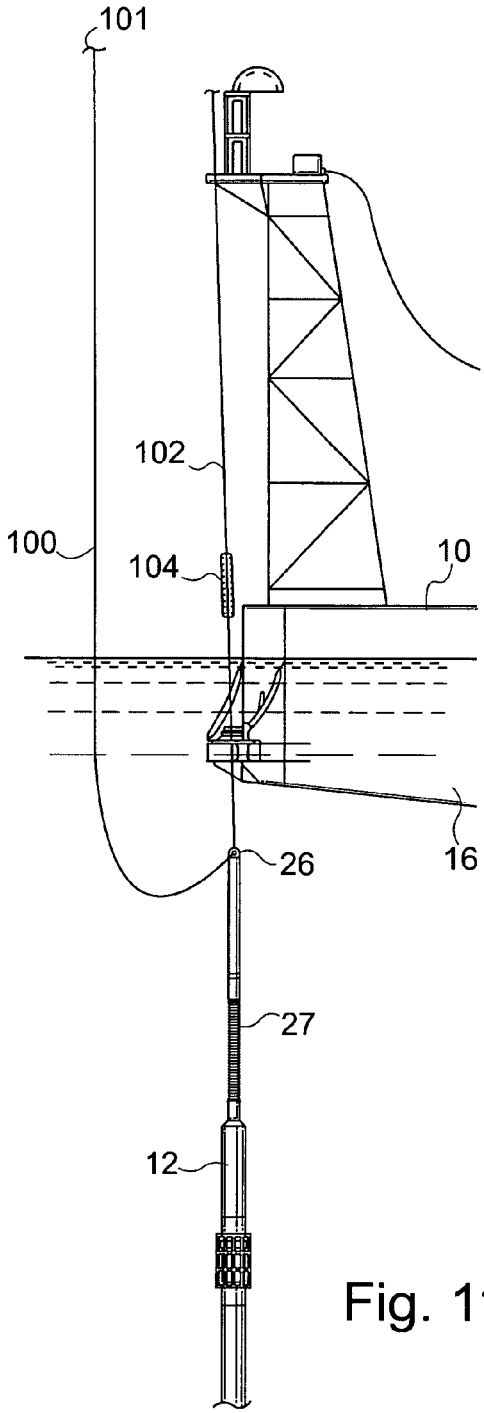
FIG. 11 illustrates a step in the method of tendon installation according to the invention wherein the tendon is suspended by a constant tension device.

In FIG. 10, a tendon 12 is freely suspended from an assembly vessel (not shown) by line 100. A second line 102 is run from a constant tension device 101 (not shown) through the connection sleeve 22 and is attached to the tip 26 of tendon 12. A motion compensation device 104, for instance a spring, is included in line 102. In FIG. 11, the tendon 12 is handed over to the TLP 10. Line 100 is then disconnected from tendon 12. This procedure is repeated for all of the tendons 12. The TLP need not be located at the installation location for this operation.

Figure 12:
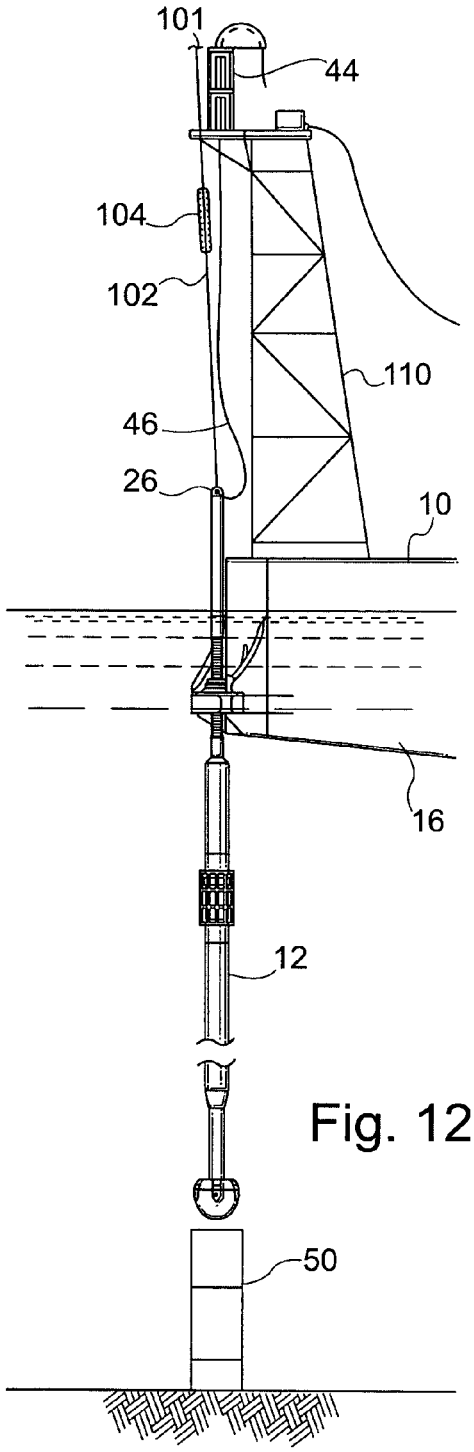
FIG. 12 illustrates a step in the method of tendon installation according to the invention wherein the tendon is poised for engagement with its foundation.

As illustrated in FIG. 12, pull-down line 46 is attached to the tip 26 of tendon 12. Strand jack tensioner 44, which is mounted on a stand 110 attached to TSS 16, receives the upper end of pull-down line 46. Tendon 12 is raised using the constant tension device 101 and line 102 so that its lower connector 120 clears its corresponding tendon foundation or pile 50. The TLP with suspended tendons is then positioned as required over the installation location.

Figure 13:
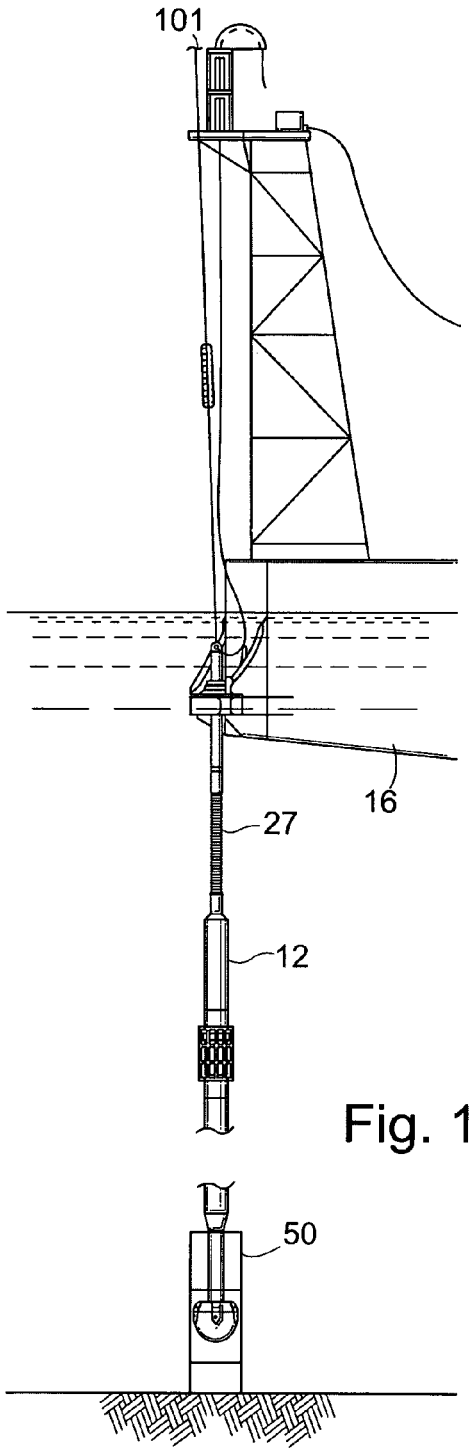
FIG. 13 illustrates a step in the method of tendon installation according to the invention wherein the tendon is installed and ready for pull down of the TLP.

As the TLP 10 is held in position over the tendon foundations 50, the tendon's lower connector 120 is stabbed into its corresponding foundation receptacle as shown in FIG. 13. While the tendon is held with the constant tension device 101 and line 102 with integral motion compensation system 104, the connector 120 is grouted or similarly fastened into the foundation pile 50. This procedure is repeated until all tendons are secured to the seabed.

Once all tendons are installed, the pull-down lines 46 are tensioned and the constant tension lines 102 are slacked. Weather permitting, the TLP is installed by tensioning the pull-down lines 46 in a similar manner as described above.

While this invention proposes a method for the installation of a TLP hull with or without a deck, the method is equally applicable to the installation of a semi-submersible type platform, in which the tendons are replaced with more or less vertically tensioned lines (chain, steel or synthetic wire, ropes made of composite materials or combination thereof).

While the preferred embodiments of the invention have been illustrated in detail, it is apparent that modifications and adaptations of the preferred embodiments will occur to those skilled in the art. Such modifications and adaptations are in the spirit and scope of the invention as set forth in the following claims:

What is claimed is:

1. A method for mooring a floating hydrocarbon drilling or production vessel to a plurality of tendons, said vessel characterized by having no temporary stability or buoyancy modules coupled thereto and by having a plurality of tensioning devices and a plurality of connection sleeves designed and arranged to receive upper ends of said tendons and be secured thereto, the method comprising the steps of, anchoring lower ends of said tendons to the seafloor, coupling a plurality of pull-down tension members from said tensioning devices to said upper ends of said tendons, tensioning said pull-down tension members using said tensioning devices to further submerge said vessel, concurrently ballasting said vessel, tensioning said pull-down tension members with high tension, submerging said vessel until said connection sleeves receive said upper ends of said tendons, coupling said connection sleeves to said tendons, and rapidly transferring said high tension from said pull-down tension members to said connection sleeves by slacking said pull-down tension members.

2. The method of claim 1 further comprising the step of, controlling tensions in said plurality of pull-down tension members by taking in at least said one of said tension members to increase its tension or paying out at least one of said tension members to decrease its tension.

3. The method of claim 1 further comprising the step of, tensioning said pull-down tension members causing said vessel to submerge without ballasting said vessel.

4. The method of claim 1 wherein said anchoring lower ends of said tendons comprises the steps of, suspending an upper end of one of said tendons from said floating vessel, positioning said tendon above a foundation anchored in seabed, lowering the lower end of said tendon into said foundation, and securing said lower end of said tendon to said foundation.

5. The method of claim 4 further comprising the step of, suspending said tendon by a constant tension device.

6. The method of claim 4 further comprising the step of, providing motion compensation between said suspended tendon and said vessel.

7. The method of claim 4 further comprising the step of, suspending said tendon by a line passing though one of said connection sleeves.

8. The method of claim 7 further comprising the steps of, raising said tendon through said connection sleeve, and then coupling one of said plurality of pull-down tension members to said upper end of said tendon.

9. The method of claim 1 wherein, said pull-down tension members pass through said connection sleeves.

10. A method for installing an offshore floating vessel, said vessel characterized by having no temporary stability or buoyancy modules coupled thereto and by having a connection sleeve designed and arranged to receive an upper end of a generally vertical tensile mooring member and be secured thereto, said mooring member having a lower end anchored to the seafloor, the method comprising the steps of, coupling a pull-down tension member from said vessel through said connection sleeve to said upper end of said mooring member, and tensioning said pull-down tension member to further submerge said vessel, tensioning said pull-down tension member to further submerge said vessel until said connection sleeve receives said upper end of said mooring member, coupling said connection sleeve to said mooring member, and after coupling said connection sleeve to said mooring member, slacking said pull-down tension member.

11. The method of claim 10 wherein, said tensioning is performed by a tensioning device.

12. The method of claim 11 wherein, said tensioning device is a winch.

13. The method of claim 11 wherein, said tensioning device is a strand jack.

14. The method of claim 11 wherein, said tensioning device is coupled to said vessel at a location above the waterline when said connecting sleeve receives said upper end of said mooring member.

15. The method of claim 11 wherein, said tensioning device is removably coupled to said vessel.

16. The method of claim 15 wherein, said tensioning device comprises a stopper or gripper.

17. The method of claim 11 further comprising the step of, routing said pull-down tension member to provide a generally vertical pull to said upper end of said tensile mooring member.

18. The method of claim 17 wherein, said routing is performed by a fairlead which is disposed between said tensioning device and said connection sleeve.

19. The method of claim 11 further comprising the step of, controlling said tensioning device locally.

20. The method of claim 11 further comprising the step of, controlling said tensioning device remotely.

21. The method of claim 10 wherein, said vessel is a tension leg platform.

22. The method of claim 21 wherein said tension leg platform has an integrated deck.

23. The method of claim 10 further comprising the step of, measuring the tension in said pull-down tension member.

* * * * *